US007076832B2

(12) United States Patent
Albert et al.

(10) Patent No.: US 7,076,832 B2
(45) Date of Patent: Jul. 18, 2006

(54) VACUUM CLEANER WITH PIVOTAL FIXTURE FOR DUST BAG REINFORCING PLATE IN A DUST BAG COMPARTMENT

(75) Inventors: Wilma Albert, Wülfershausen (DE); Herbert Kess, Bad Neustadt (DE); Albert Kleinhenz, Burgwallbach (DE); Sebastian Räder, Bastheim (DE); Andreas Schlereth, Bad Neustadt (DE); Thomas Seith, Bad Neustadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/791,547

(22) Filed: Mar. 1, 2004

(65) Prior Publication Data

US 2004/0163205 A1 Aug. 26, 2004

Related U.S. Application Data

(63) Continuation of application No. PCT/EP02/09513, filed on Aug. 26, 2002.

(30) Foreign Application Priority Data

Aug. 30, 2001 (DE) ..... 101 42 509

(51) Int. Cl.
*A47L 9/14* (2006.01)

(52) U.S. Cl. ..... 15/352; 55/373; 55/376

(58) Field of Classification Search ..... 15/327.1, 15/327.2, 327.7, 347, 350–352; 55/373, 55/374, 376, DIG. 2, DIG. 3
See application file for complete search history.

(56) References Cited

U.S. PATENT DOCUMENTS

| | | | | |
|---|---|---|---|---|
| 2,742,105 A | | 4/1956 | Dow | |
| 3,328,942 A | | 7/1967 | Waters | |
| 3,933,451 A | * | 1/1976 | Johansson | 55/367 |
| 4,545,794 A | * | 10/1985 | Himukai | 55/362 |
| 4,591,369 A | | 5/1986 | Stewart, Sr. et al. | |
| 4,733,430 A | | 3/1988 | Westergren | |
| 5,089,038 A | * | 2/1992 | Kopco et al. | 55/374 |
| 5,701,631 A | * | 12/1997 | Lindquist | 15/327.1 |
| 5,755,009 A | | 5/1998 | Stephens et al. | |
| 5,935,280 A | * | 8/1999 | Lee | 55/378 |

FOREIGN PATENT DOCUMENTS

| | | | |
|---|---|---|---|
| DE | 40 13 572 | * | 11/1990 |
| DE | 40 13 572 C2 | | 11/1990 |
| DE | 39 20 313 | * | 1/1991 |
| DE | 44 29 342 | * | 2/1996 |
| DE | 199 42 483 C1 | | 2/2001 |
| EP | 0 202 639 A2 | | 11/1986 |
| JP | 7-171077 | * | 12/1993 |
| JP | 8-196489 | * | 8/1996 |
| WO | WO 02/24047 | * | 3/2002 |

* cited by examiner

*Primary Examiner*—Terrence R. Till
(74) *Attorney, Agent, or Firm*—John T. Winburn; Russell W. Warnock; Craig J. Loest

(57) ABSTRACT

A vacuum cleaner includes a dust collection compartment inside of which a dust bag with a reinforcing plate, which has a clip connected to the underside thereof, can be placed. The clip tapers toward the bottom in the shape of a funnel or trapezoid and is suited for insertion into a correspondingly configured fixture. The fixture has lateral guide elements that guide the reinforcing plate when pushed in. The configuration enables the dust bag to be easily inserted into the dust collection compartment without the involving the difficult placement inside a guide profile.

15 Claims, 3 Drawing Sheets

VACUUM CLEANER WITH PIVOTAL FIXTURE FOR DUST BAG REINFORCING PLATE IN A DUST BAG COMPARTMENT

CROSS-REFERENCE TO RELATED APPLICATION

This application is a continuation, under 35 U.S.C. § 120, of copending international application No. PCT/EP02/09513, filed Aug. 26, 2002, which designated the United States; this application also claims the priority, under 35 U.S.C. § 119, of German patent application No. 101 42 509.0, filed Aug. 30, 2001; the prior applications are herewith incorporated by reference in their entirety.

BACKGROUND OF THE INVENTION

Field of the Invention

The present invention relates to a vacuum cleaner with a dust collection compartment provided in an appliance housing, which can be closed with a cover, and with a pivotable fixture for a reinforcing plate of a dust bag for insertion in the dust collection compartment.

Such a vacuum cleaner is already well known and is marketed by the applicant.

U.S. Pat. No. 2,742,105 to Dow discloses a vacuum cleaner, in which a swivel-mounted locking member in the form of a lift arm is provided. The dust bag is installed separately from the locking member. In the case of a dust bag not installed properly, the lift arm juts into the closing path of the cover closing off the dust collection compartment. The locking member is disposed such that it is pressed out of its locking position by a reinforcing plate provided on the dust bag against the force of a spring.

German Patent DE 40 13 572 C2 discloses a vacuum cleaner, in which the reinforcing plate is pushed into a fixture, which has lateral U-shaped profiled rails. The reinforcing plate is pushed in between the profiled rails opposite one another with their open sides. Also provided and serving as a locking member or filter barrier is a slide, which is disposed in the adjustment range of the cover and, thus, engages with the cover when the cover is closed, whereby it is pressed by a spring in the direction of the cover into a locking position. When a reinforcing plate of a dust bag is used, the locking member moves out of its locking position. If the reinforcing plate is missing, the locking member blocks closing of the cover. The locking member is guided through a longitudinal guide configured as a long hole and completes both a pivoting movement and a shift in a longitudinal direction.

SUMMARY OF THE INVENTION

It is accordingly an object of the invention to provide a vacuum cleaner including a pivotal fixture for a reinforcing plate of a dust bag that can be placed inside a dust bag compartment that overcomes the hereinafore-mentioned disadvantages of the heretofore-known devices of this general type and that improves upon a vacuum cleaner of the type initially outlined.

With the foregoing and other objects in view, there is provided, in accordance with the invention, vacuum cleaner, including an appliance housing defining a dust collection compartment, a dust bag removably inserted into the dust collection compartment and having a reinforcing plate with a clip, a movable cover selectively opening and closing the dust collection compartment, and a pivotable fixture connected to the reinforcing plate, the fixture having lateral guide elements and a surface shaped in at least one of the group consisting of a funnel and a trapezoid, the surface and the and lateral guide elements bearing the clip of the reinforcing plate.

According to the present invention, the fixture has a surface in the shape of a funnel or trapezoid for bearing of a clip attached to the reinforcing plate and lateral guide elements.

As such, simple, light, hygienic, and error-free insertion of the reinforcing plate together with the dust bag covered with this is made possible. The dust bag must not be pushed into narrow guide rails. The reinforcing plate can easily be pushed down by the surface in the shape of a funnel or trapezoid and it slides downwards in the set position without lateral tilting or interlocking. As such, a dust bag, which has been incorrectly inserted, can be brought into the final use position by closing the cover. The insertion procedure is, thus, supported or completed by closing the cover, if the dust bag has been placed in position only partially and the reinforcing plate has not yet assumed the position, in which the air inlet opening in the reinforcing plate lies centrally to the air inlet connector of the cover.

A vacuum cleaner, in which the clip on the reinforcing plate is provided with lateral recesses, in which projections attached to the fixture engage, is particularly suitable.

In accordance with another feature of the invention, the cover has a closing range and the locking member is a projection attached to at least one of the guide elements and projects into the closing range of the cover when the reinforcing plate is absent.

In accordance with a further feature of the invention, the fixture is swivel-mounted against the force of a spring, and a locking member is present and can be pivoted in the direction of the adjustment range of the cover, which is swung into a first position in the adjustment range of the cover preventing the cover from closing when the reinforcing plate is missing, and which is swung into a second position in the adjustment range enabling closing of the cover when the reinforcing plate is in use. Due to this particular measure, the locking member is a simple element, which can be swivelled together with the fixture. Because of the connection between the locking member and the fixture for the reinforcing plate, a separate fixture for the locking member is dispensed with. A dust bag in such an application is any container fully closed to or only partially closed as far as the air inlet opening, which is suitable for the dust fixture.

Here, a leaf spring is particularly suitable as the spring. Whenever the cover is open, the fixture is held in the locked position by the spring. Only when a reinforcing plate is present can the fixture be swung out of this position.

In accordance with an added feature of the invention, the locking member is advantageously formed by a projection attached to at least one of the guide elements, which projects into the closing region of the cover when the reinforcing plate is missing.

Particularly suitable here is an embodiment of the vacuum cleaner in which the reinforcing plate can be swivelled into the second position by an air inlet connector attached in the cover while the cover is being closed.

To support positioning of the reinforcing plate and, thus, of the whole dust bag, notching for catching the upper edge of the reinforcing plate is, preferably, provided on the inside of the cover. Due to the notching, the reinforcing plate is pushed down on account of the downwards-folding cover.

Alternatively or in addition to such a measure, an air inlet opening having an edge in the reinforcing plate running parallel to the upper edge of the reinforcing plate in its lower region can be provided, through which the reinforcing plate can be displaced downwards by the air inlet connector in the cover.

The invention also relates to a dust bag for insertion in a vacuum cleaner. Such a dust bag has a reinforcing plate, which has on its underside a clip tapering downwards in the shape of a funnel or trapezoid.

With the objects of the invention in view, there is also provided a vacuum cleaner, including an appliance housing defining a dust collection compartment for removably receiving a dust bag therein, the dust bag having a reinforcing plate with a clip, a movable cover selectively opening and closing the dust collection compartment, and a pivotable fixture to be connected to the reinforcing plate of the dust bag, the fixture having lateral guide elements and a surface shaped in at least one of the group consisting of a funnel and a trapezoid, the surface and the and lateral guide elements configured to bear the clip of the reinforcing plate.

With the objects of the invention in view, there is also provided a vacuum cleaner, including an appliance housing defining a dust collection compartment, a dust bag removably inserted into the dust collection compartment and having a reinforcing plate with a clip, a movable cover selectively opening and closing the dust collection compartment, and a pivotable fixture connected to the reinforcing plate, the fixture having lateral guide elements and a surface shaped in at least one of the group consisting of a funnel and a trapezoid for bearing the clip of the reinforcing plate.

With the objects of the invention in view, in a vacuum cleaner having an appliance housing defining a dust collection compartment for removably receiving a dust bag, the dust bag having a reinforcing plate with a clip, there is also provided a a bag holding configuration including a movable cover selectively opening and closing the dust collection compartment and a pivotable fixture connected to the reinforcing plate of the dust bag, the fixture having lateral guide elements and a surface shaped in at least one of the group consisting of a funnel and a trapezoid, the surface and the and lateral guide elements bearing the clip of the reinforcing plate.

Other features that are considered as characteristic for the invention are set forth in the appended claims.

Although the invention is illustrated and described herein as embodied in a vacuum cleaner including a pivotal fixture for a reinforcing plate of a dust bag that can be placed inside a dust bag compartment, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
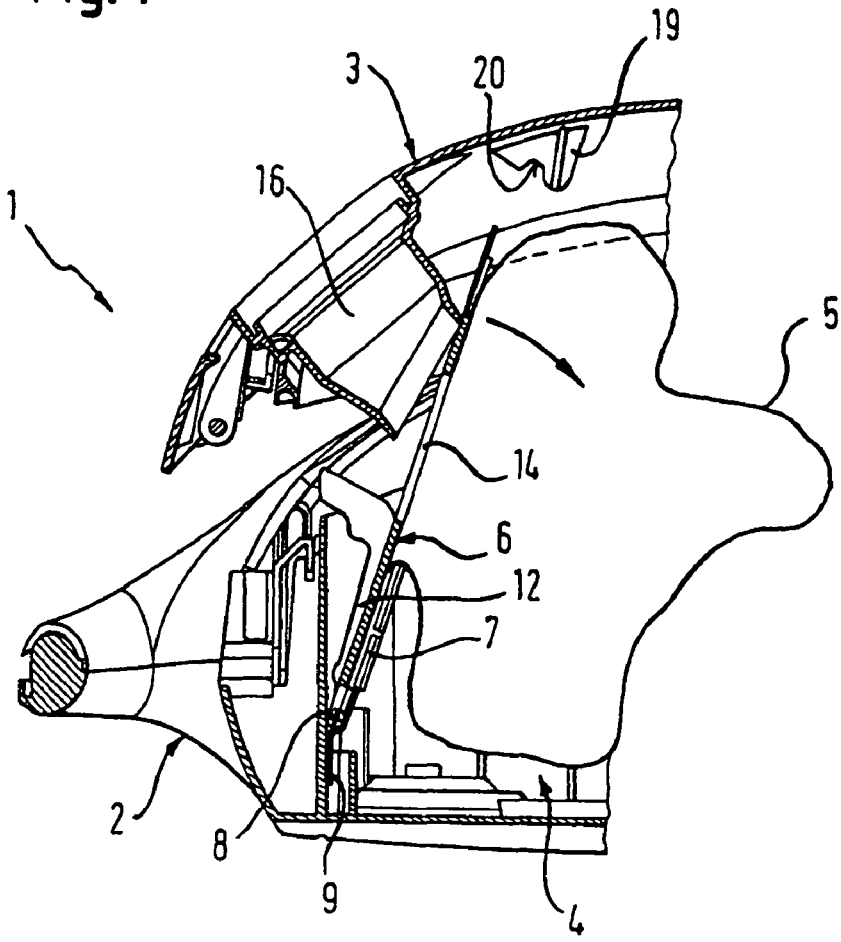
FIG. 1 is a fragmentary, cross-sectional view of a vacuum cleaner according to the invention with a dust collection compartment, an open cover, and an inserted dust bag.

Referring now to the figures of the drawings in detail and first, particularly to FIG. 1 thereof, there is shown a vacuum cleaner 1 having an under part 2 and a cover 3. The under part 2 has a dust collection compartment 4 housing a dust bag 5. The dust bag 5 has a reinforcing plate 6, which is stuck in a fixture 7. On its lower end, the fixture 7 has a swivel shaft 8 and is spring-mounted by a leaf spring 9 attached in its lower region opposite the under part 2, whereby the leaf spring 9 is stuck in a corresponding fixture.

Figure 2:
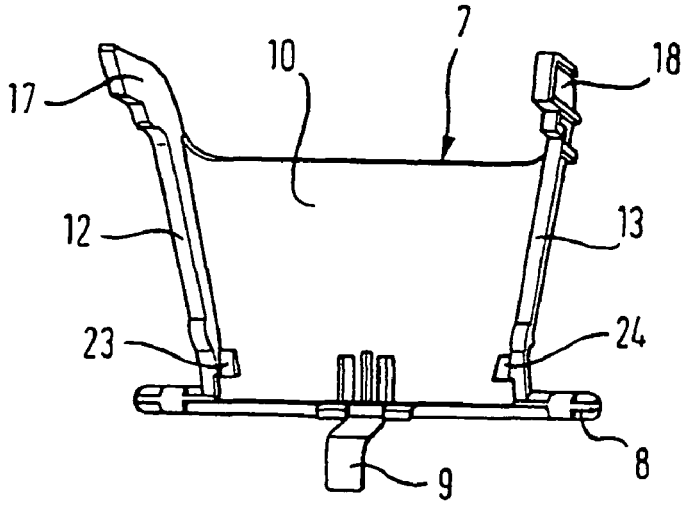
FIG. 2 is a perspective view of a fixture for a reinforcing plate according to the invention.
Figure 3:
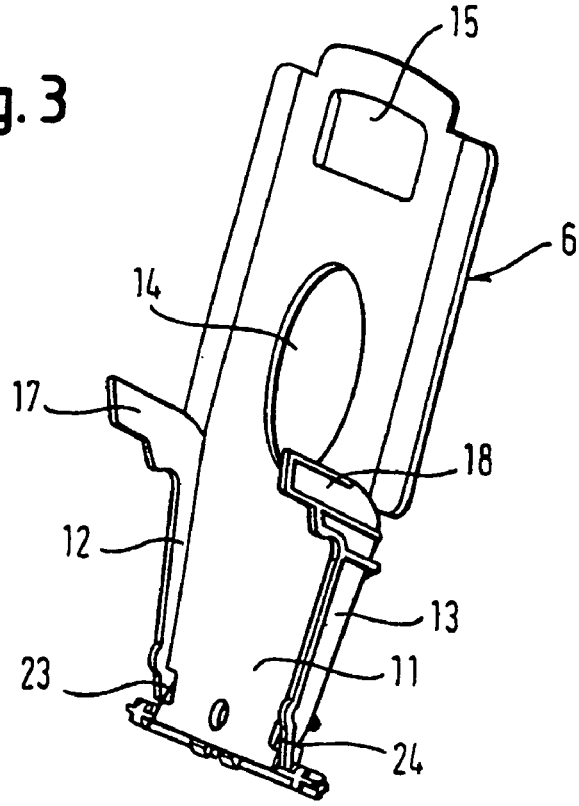
FIG. 3 is a perspective view of the fixture of FIG. 2 with an inserted reinforcing plate.
Figure 4:
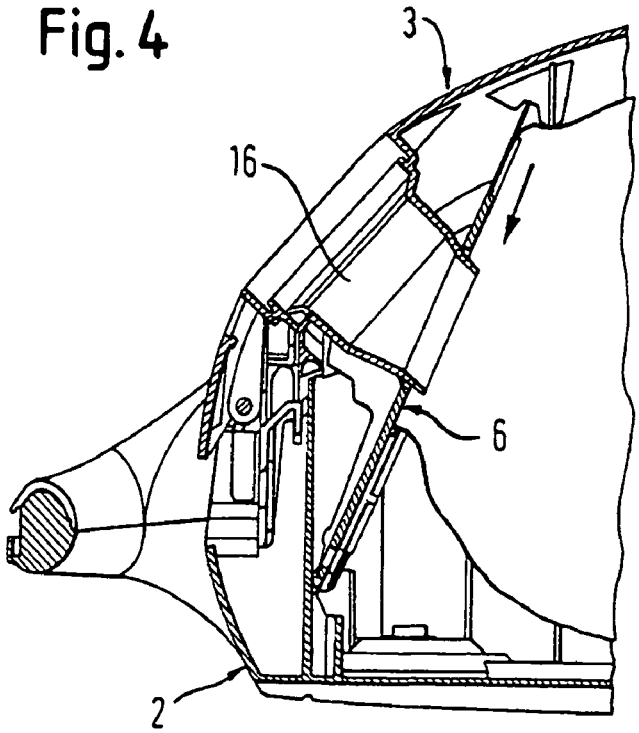
FIG. 4 is a fragmentary perspective view of the vacuum cleaner of FIG. 1 in a closed state.

The fixture 7 has a downwards tapering surface 10 in the shape of a funnel or trapezoid (see FIG. 2) for bearing a clip 11 (see FIG. 3), which is disposed on the underside of the reinforcing plate 6, for the purpose of pushing the latter down easily between guide elements 12 and 13 of the fixture 7. The clip 11, thus, has a contour in the shape of a funnel or trapezoid likewise adapted to the surface 10. The reinforcing plate 6 also has an air inlet opening 14 and a grip aperture 15. The air inlet opening 14 has a non-illustrated rubber seal, which terminates airtightly opposite an inlet connector 16 in the cover 3.

Figure 5:
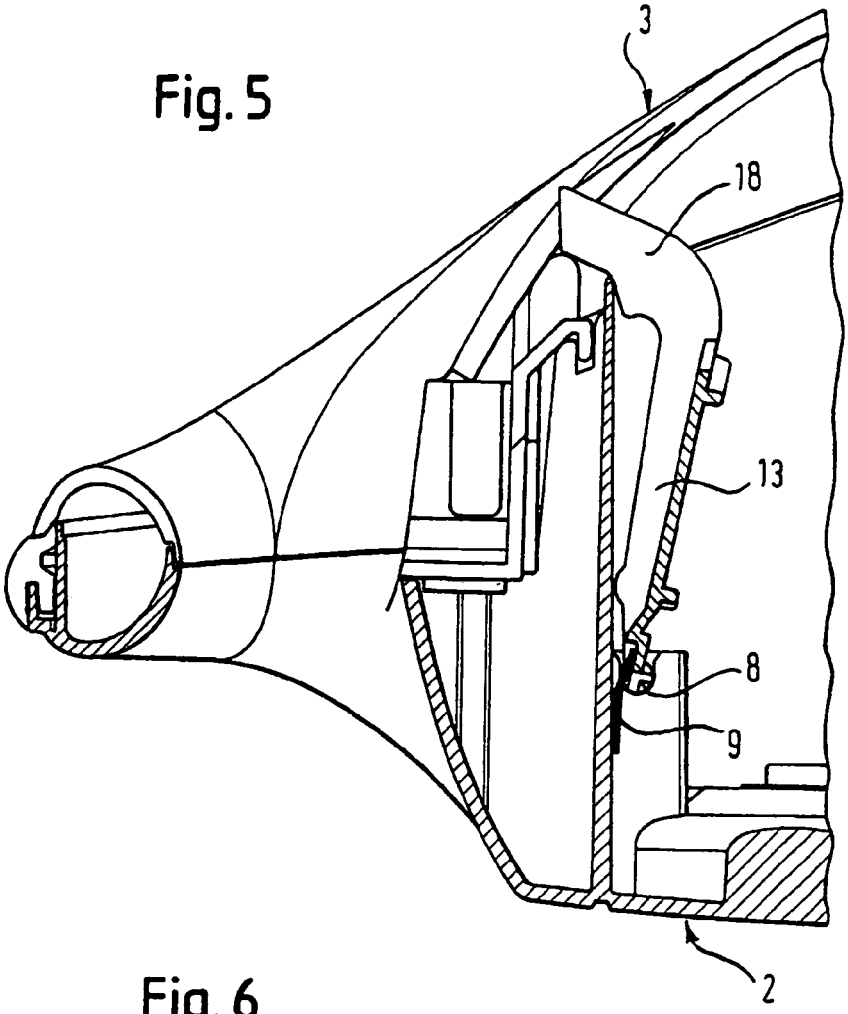
FIG. 5 is fragmentary perspective view of the vacuum cleaner of FIG. 1 without the dust bag and being slightly enlarged as compared to FIG. 1.

In each case, the guide elements 12 and 13 have on their upper end projections 17 and 18 pointing forwards to the opening of the dust collection compartment 4, which in each case form a locking member and prevent complete closing of the dust collection compartment 4 by the cover 3 (see FIG. 5) when the reinforcing plate 6 is absent. In this case, the projections 17 and 18 are in the closing range of the cover 3, which prevents vacuumed dirt, in particular, lint and threads, from entering the motor housing and causing damage when the dust bag 5 is not in place.

When the reinforcing plate 6 is pushed into the fixture 7, the reinforcing plate 6 is pushed far down by the inlet connector 16 engaging in the air inlet opening 14 and by an element 19 attached to the underside of the cover 3 with notching 20 through swivelling of the cover 3, until the reinforcing plate 6 is seated firmly in the fixture 7. Compare FIG. 1 to FIG. 4.

Good seating of the reinforcing plate 6 is supported if the clip 11 is provided with lateral recesses 21 and 22 (FIG. 3, 6), in which projections 23 and 24 (FIG. 2) attached to the fixture 7 engage or snap-lock.

Figure 6:
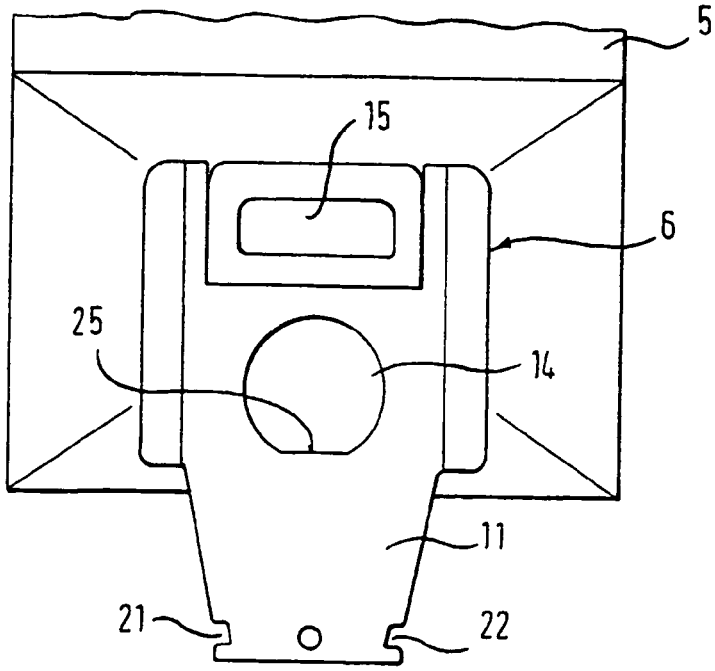
FIG. 6 is a fragmentary plan view of a dust bag with the reinforcing plate of FIG. 3.

To support lowering of the reinforcing plate 6 in the fixture 7 when a new dust bag 5 is inserted, an advantageous embodiment of the invention provides that the air inlet opening 14 in the reinforcing plate is not circular, but has in its lower region a straight edge 25 (FIG. 6). The inlet connector 16, then, sits on the straight edge 25 when the cover 3 is closed and presses the reinforcing plate 6 down. In such a case, the element 19 can also be dispensed with.

Through the invention, a vacuum cleaner 1 with a dust collection compartment 4 is produced, in which a dust bag 5 with a reinforcing plate 6 can be inserted having a clip 11 set on its underside. The clip 11 tapers downwards in the shape of a funnel or trapezoid and is suitable for pushing into a fixture 7, which is configured accordingly. The fixture 7 has lateral guide elements 12, 13 that guide the reinforcing plate 6 as it is being inserted. Such a configuration enables easy introduction of the dust bag 5 into the dust collection compartment 4 without complicated insertion in a guide profile.

The invention also provides a dust bag 5 with a reinforcing plate 6 that is adapted for the fixture 7 and easy introduction of the reinforcing plate 6 enables the latter to taper downwards in the shape of a funnel or trapezoid.

We claim:

1. A vacuum cleaner, comprising:

an appliance housing defining a dust collection compartment;

a dust bag removably inserted into said dust collection compartment and having a reinforcing plate with a clip;

a movable cover selectively opening and closing said dust collection compartment;

a pivotable fixture connected to said reinforcing plate, said fixture having lateral guide elements and a surface shaped in at least one of the group consisting of a funnel and a trapezoid, said surface and said and lateral guide elements bearing said clip of said reinforcing plate;

said cover has an adjustment range with at least first and second positions;

a locking member pivots in a direction of said adjustment range of said cover;

said cover swings into:

a first position where said locking member prevents said cover from closing when said reinforcing plate is absent; and a second position where said locking member permits closure of said cover when said reinforcing plate is in use;

a spring is provided and produces a bias force; and said fixture is swivel-mounted against said bias force of said spring.

2. The vacuum cleaner according to claim 1, wherein:

said fixture has projections; and said clip has lateral recesses in which said projections engage.

3. The vacuum cleaner according to claim 1, wherein:

said cover has a closing range; and said locking member is a projection attached to at least one of said guide elements and projects into said closing range of said cover when said reinforcing plate is absent.

4. The vacuum cleaner according to claim 1, wherein said spring is a leaf spring.

5. The vacuum cleaner according to claim 1, wherein:

said cover has an air inlet connector; and said reinforcing plate swivels into said second position by said air inlet connector during closing of said cover.

6. The vacuum cleaner according to claim 5, wherein:

said reinforcing plate has:

an upper edge; and an air inlet opening with a lower region and an edge running parallel to said upper edge in said lower region, said reinforcing plate moving downwards by contact between said air inlet connector and said edge.

7. The vacuum cleaner according to claim 1, wherein:

said reinforcing plate has an underside and said clip is disposed on said underside; and said clip tapers downwards in a shape selected from at least one of the group consisting of a funnel and a trapezoid.

8. The vacuum cleaner according to claim 1, wherein:

said reinforcing plate has an underside and said clip is disposed on said underside; and said reinforcing plate tapers downwards in a shape selected from at least one of the group consisting of a funnel and a trapezoid.

9. The vacuum cleaner according to claim 1, wherein said locking member swivels with said fixture.

10. A vacuum cleaner, comprising:

an appliance housing defining a dust collection compartment;

a dust bag removably inserted into said dust collection compartment and having a reinforcing plate with a clip;

a movable cover selectively opening and closing said dust collection compartment;

a pivotable fixture connected to said reinforcing plate, said fixture having lateral guide elements and a surface shaped in at least one of the group consisting of a funnel and a trapezoid, said surface and said and lateral guide elements bearing said clip of said reinforcing plate;

said reinforcing plate has an upper edge; and said cover has an inside surface with notching thereon for catching said upper edge of said reinforcing plate.

11. A vacuum cleaner, comprising:

an appliance housing defining a dust collection compartment;

a dust bag removably inserted into said dust collection compartment and having a reinforcing plate with a clip;

a movable cover selectively opening and closing said dust collection compartment;

a pivotable fixture connected to said reinforcing plate, said fixture having lateral guide elements and a surface shaped in at least one of the group consisting of a funnel and a trapezoid, said surface and said and lateral guide elements bearing said clip of said reinforcing plate;

said cover has an air inlet connector; and said reinforcing plate has:

an upper edge; and an air inlet opening with a lower region and an edge running parallel to said upper edge in said lower region, said reinforcing plate moving downwards by contact between said air inlet connector and said edge.

12. A vacuum cleaner, comprising:

an appliance housing defining a dust collection compartment;

a cover coupled to the housing and movable between an open condition, in which the dust collection compartment is exposed, and a closed condition, in which the cover closes the dust collection compartment;

a fixture coupled to the housing and including a locking member, the fixture being movable between a locked condition, in which the locking member restricts the cover from moving to the closed condition, and an unlocked condition, in which the locking member permits the cover to move to the closed condition; and a dust bag removably insertable into the dust collection compartment and having a reinforcing plate engaging the fixture and defining an air inlet opening, the cover including an air inlet connector engaging the reinforcing plate to move the fixture toward the unlocked condition in response to movement of the cover toward the closed condition.

13. The vacuum cleaner according to claim 12, wherein the locking member includes a projection extending between the cover and the appliance housing in the locked condition to restrict the cover from moving to the closed condition.

14. The vacuum cleaner according to claim 12, wherein the fixture remains in the locked condition when the reinforcing plate is absent from the fixture.

15. The vacuum cleaner according to claim 12, further comprising a spring biasing the fixture toward the locked condition.

* * * * *